US011864702B2

(12) United States Patent
Bishop et al.

(10) Patent No.: US 11,864,702 B2
(45) Date of Patent: Jan. 9, 2024

(54) MULTIFUNCTIONAL TOOL

(71) Applicant: THE AMES COMPANIES, INC., Camp Hill, PA (US)

(72) Inventors: Ryan Barclay Bishop, Ocala, FL (US); Thomas Mcmahon, Celebration, FL (US)

(73) Assignee: The Ames Companies, Inc., Camp Hill, PA (US)

( * ) Notice: Subject to any disclaimer, the term of this patent is extended or adjusted under 35 U.S.C. 154(b) by 0 days.

(21) Appl. No.: 18/019,849

(22) PCT Filed: Aug. 5, 2021

(86) PCT No.: PCT/US2021/044663

§ 371 (c)(1),
(2) Date: Feb. 6, 2023

(87) PCT Pub. No.: WO2022/031923

PCT Pub. Date: Feb. 10, 2022

(65) Prior Publication Data

US 2023/0210336 A1 Jul. 6, 2023

Related U.S. Application Data

(60) Provisional application No. 63/061,427, filed on Aug. 5, 2020.

(51) Int. Cl.
*A47L 13/12* (2006.01)
*A46B 5/00* (2006.01)
(Continued)

(52) U.S. Cl.
CPC ..... *A47L 13/12* (2013.01); *A46B 5/0095* (2013.01); *A46B 7/042* (2013.01); *A47L 13/11* (2013.01);
(Continued)

(58) Field of Classification Search
CPC ..... A46B 15/0081; A46B 15/0095; A46B 15/0097; A46B 17/04; A46B 9/10;
(Continued)

(56) References Cited

U.S. PATENT DOCUMENTS 2,533,838 A * 12/1950 Ranft ..... A46B 15/00 15/246
D591,514 S 5/2009 McNeil et al.
(Continued)

FOREIGN PATENT DOCUMENTS

BR 2020180138133 U2 1/2020
CA 2860075 C 1/2018
(Continued)

OTHER PUBLICATIONS

International Search Report and Written Opinion for Application No. PCT/US2021/044663, dated Nov. 15, 2021, 3 pages.
(Continued)

*Primary Examiner* — Shay Karls
(74) *Attorney, Agent, or Firm* — Brooks Kushman P.C.

(57) ABSTRACT

A multifunctional tool is provided with a first functional element connected to the first housing member and extending outwardly therefrom to a first distal end, and a second housing member supported by the first housing member for translation relative to the first housing member between a first position and a second position. A second functional element is supported by the second housing member and extending outwardly therefrom to a second distal end. The second distal end is positioned between the first housing member and the first, distal end with the second housing member in the first position. The first distal end is positioned between the first housing member and the second distal end with the second housing member in the second position.

21 Claims, 13 Drawing Sheets

(51) Int. Cl.
*A46B 7/04* (2006.01)
*A47L 13/11* (2006.01)
*A47L 13/16* (2006.01)

(52) U.S. Cl.
CPC ..... *A47L 13/16* (2013.01); *A46B 2200/302* (2013.01)

(58) Field of Classification Search
CPC ... A46B 9/06; A46B 7/02; A47L 13/12; A47L 13/10; A47L 13/20
See application file for complete search history.

(56) References Cited

U.S. PATENT DOCUMENTS

| | | | | |
|---|---|---|---|---|
| 8,196,249 | B1 * | 6/2012 | Spooner | B25G 1/04 15/117 |
| 8,533,890 | B2 * | 9/2013 | Pannell | A47L 13/022 16/427 |
| D764,733 | S | 8/2016 | Kandasamy et al. | |
| 9,420,876 | B2 | 8/2016 | Biagi | |
| 9,615,652 | B2 | 4/2017 | Weis et al. | |
| 2002/0166186 | A1 | 11/2002 | Fernandez | |
| 2015/0272310 | A1 | 10/2015 | Butler | |
| 2019/0059212 | A1 | 2/2019 | Njenga | |
| 2019/0269292 | A1 * | 9/2019 | Taboh | A47L 13/08 |
| 2020/0015648 | A1 | 1/2020 | Gwen | |

FOREIGN PATENT DOCUMENTS

| | | | |
|---|---|---|---|
| EP | 2793648 | B1 | 10/2018 |
| GB | 2151467 | A | 7/1985 |
| WO | 2005016067 | A2 | 2/2005 |

OTHER PUBLICATIONS

International Preliminary Report on Patentability for Application No. PCT/US2021/044663, dated Jan. 19, 2023, 13 pages.
Amazon.com, "O-Cedar Dual-Action Angler Broom with Dust Pan", Aug. 5, 2017, 7 pages.
Bissell.com, "Dual Action Pet Hair and Multi-Surface Broom", downloaded May 14, 2020, 3 pages.

* cited by examiner

MULTIFUNCTIONAL TOOL

CROSS-REFERENCE TO RELATED APPLICATIONS

This application claims the U.S. national phase of PCT Application No. PCT/US2021/044663 filed Aug. 5, 2021, which claims the benefit of U.S. provisional application Ser. No. 63/061,427 filed Aug. 5, 2020, the disclosures of which are hereby incorporated in their entirety by reference herein.

TECHNICAL FIELD

Various embodiments relate to a tool such as a cleaning apparatus.

BACKGROUND

Conventionally, a cleaning apparatus is provided with a single cleaning element, or a tool is provided with a single functional element. A user may have multiple cleaning apparatuses for use on different surfaces, or for use in cleaning up different types of messes. For example, a user may have two different cleaning apparatuses. Both of these need to be stored, which takes up valuable storage or closet space. Additionally, during cleaning the user may have to use and carry both cleaning apparatuses.

SUMMARY

According to various embodiments of the disclosure, a multifunctional tool is provided with a first housing member, a first functional element connected to the first housing member and extending outwardly therefrom to a first distal end, a second housing member supported by the first housing member for translation relative to the first housing member between a first position and a second position, and a second functional element supported by the second housing member and extending outwardly therefrom to a second distal end. The second distal end is positioned between the first housing member and the first distal end with the second housing member in the first position. The first distal end is positioned between the first housing member and the second distal end with the second housing member in the second position.

According to further embodiments, a handle is connected to and extending outwardly from the first housing member, with the handle being fixed relative to the first housing member.

According to further embodiments, the second housing member translates along a longitudinal axis of the handle.

According to further embodiments, the second functional element is different from the first functional element.

According to further embodiments, the second housing member defines a cavity, and the first housing member is received within the cavity.

According to further embodiments, a mechanism is provided to retain the second housing member in each of the first and second positions.

According to further embodiments, the mechanism comprises at least one locking element supported by one of the first and second housing members, and an opening defined by the other of the first and second housing members.

According to further embodiments, the at least one locking element defines a clip protrusion, with the clip protrusion cooperating with the opening to retain the second housing element in one of the first and second positions.

According to further embodiments, a kick plate is supported by one of the first and second housing members and connected to the mechanism, the kick plate operable by a user to engage the mechanism to move the second housing member between the first and second positions.

According to further embodiments, the first functional element is one of a rubber brush, a first microfiber, a second microfiber, a squeegee, a foam member, an angled brush, a light stiffness brush, a medium stiffness brush, a heavy stiffness brush, an eraser, a scraper, and a magnetic bar.

According to further embodiments, the second functional element is another of the rubber brush, the first microfiber, the second microfiber, the squeegee, the foam member, the angled brush, the light stiffness brush, the medium stiffness brush, the heavy stiffness brush, the eraser, the scraper, and the magnetic bar.

According to further embodiments, the first housing member defines a handle support member extending outwardly from a first end region, and a lower face defined by a second end region opposite to the first end region. The first functional element extends outwardly from the lower face.

According to further embodiments, the second housing member defines an outer side wall extending outwardly from an upper wall, the outer side wall and upper wall defining a cavity. The first housing member is sized to be received within the cavity.

According to further embodiments, the first housing member defines a slot extending therethrough and intersecting the lower face. The second housing member defines a divider extending outwardly from the upper wall and positioned within the cavity, with the divider extending through the slot.

According to further embodiments, the divider defines a series of ribs extending outwardly therefrom to position the first housing member relative to the second housing member.

According to further embodiments, the second functional element is connected to the divider.

According to further embodiments, a first portion of the first functional element and a second portion of the first functional element extend outwardly from the lower face of the first housing member, the slot positioned between the first and second portions of the first functional element.

According to further embodiments, the first functional element is a brush.

According to further embodiments, the second functional element is one of a microfiber, a squeegee, an eraser, and a magnetic bar.

According to further embodiments, the upper wall defines an aperture, the handle support member extending through the aperture.

According to further embodiments, the first housing member defines first and second locking elements, the handle support member positioned between the first and second locking elements. The upper wall defines first and second slots, with the aperture positioned between the first and second slots. The first and second slots are sized to receive the first and second locking elements, respectively, to retain the second housing member in one of the first and second positions.

According to further embodiments, the first housing member defines a first guide element, and the second housing member defines a second guide element cooperating with the first guide element.

DETAILED DESCRIPTION

Figure 1:
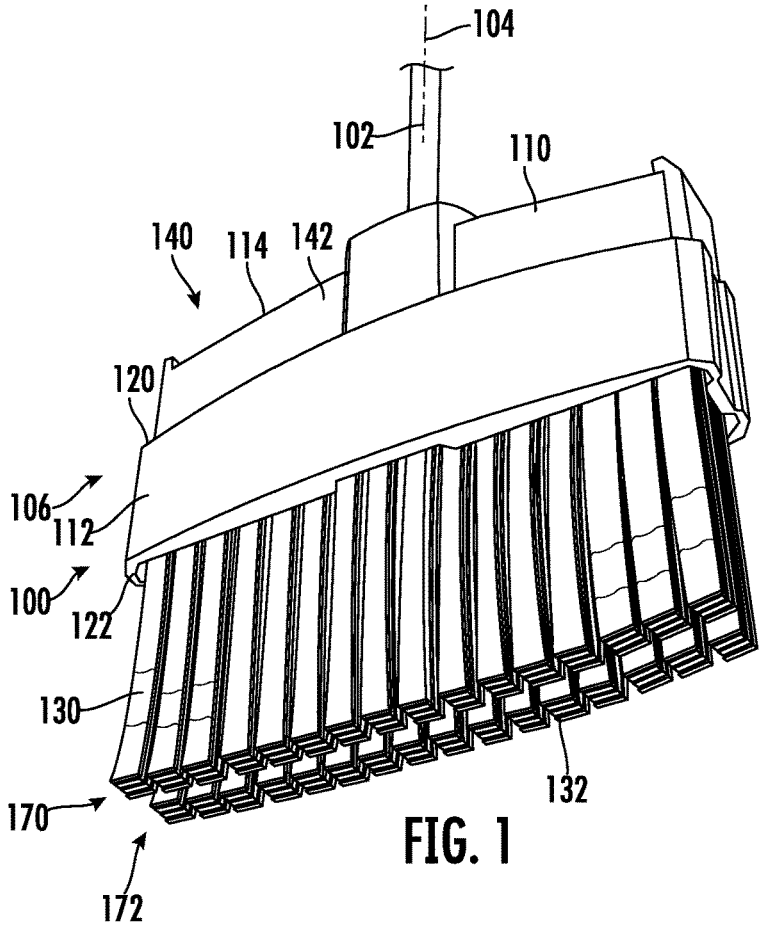
FIG. 1 illustrates a partial perspective view of a multifunctional tool according to an embodiment with a first functional element in a first position.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-7 illustrate a multifunctional tool 100 according to an embodiment and with two functional elements that may be selected for use. In the example shown, the multifunctional tool is a cleaning apparatus 100, and the elements are provided as cleaning elements. In other examples, the multifunctional tool may be another type of multifunctional tool with assorted elements. For example, the multifunctional tool may be a landscape or gardening tool or apparatus, and the elements may be various tools for use in landscaping or gardening. By way of a non-limiting example, the description below describes the tool 100 as being a cleaning apparatus with two associated cleaning elements.

The cleaning apparatus 100 has a handle 102. The handle may extend along a longitudinal axis 104. The handle 102 may have sufficient length such that a user may stand and use the cleaning apparatus on a floor surface. In other embodiments, the handle 102 may have shorter or longer lengths, or may have an adjustable length.

A housing assembly 106 is connected to a distal end of the handle 102. The housing assembly 106 may have a first housing member 110 and a second housing member 112 that are connected to one another. One of the housing members 110, 112 is fixed relative to the handle 102 such that it does not move relative to the handle, and supports the other housing member 112, 110 for relative movement thereto.

In the example shown, the first housing member 110 is connected and fixed relative to the handle 102. The second housing member 112 is supported by the first housing member 110 and moves relative to the first housing member 110 between a first position and a second position.

The first housing member 110 has a first end region 114 and a second end region opposite to the first end region 114. In various examples, the second end region may face away from the handle 102. The handle 102 extends outwardly from the first end region. A first functional element 116, or first cleaning element 116, is connected to the first housing member 110 and extends outwardly from the second end region. In one example, the handle 102 and the first cleaning element 116 each lie in a plane that also contains the longitudinal axis 104.

In various examples, the first cleaning element 116 extends transversely across the first housing member 110. The first cleaning element 116 extends from a proximal end that is connected to the first housing member 110 to a distal end 118.

Figure 2:
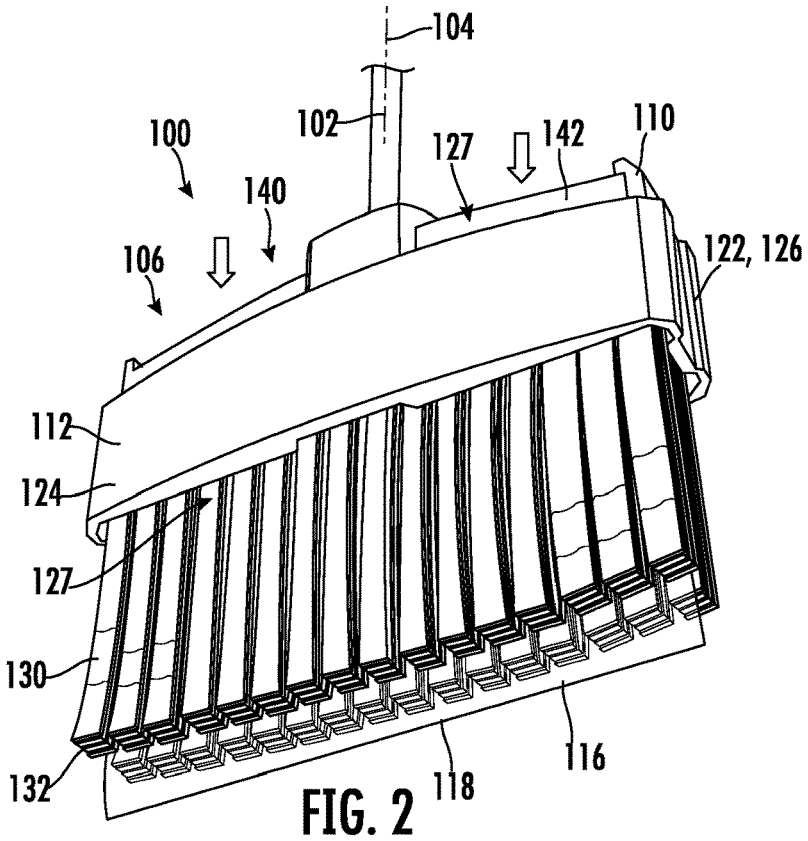
FIG. 2 illustrates another partial perspective view of the multifunctional tool of FIG. 1 with the first functional element in a second position.
Figure 3:
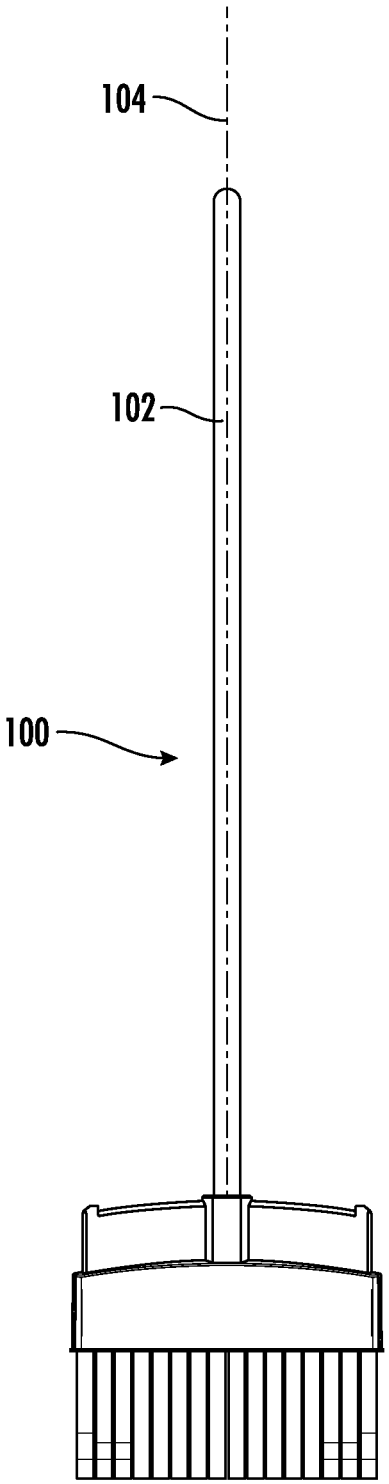
FIG. 3 illustrates a front view of the multifunctional tool apparatus of FIG. 1 with the a first functional element in the first position.
Figure 4:
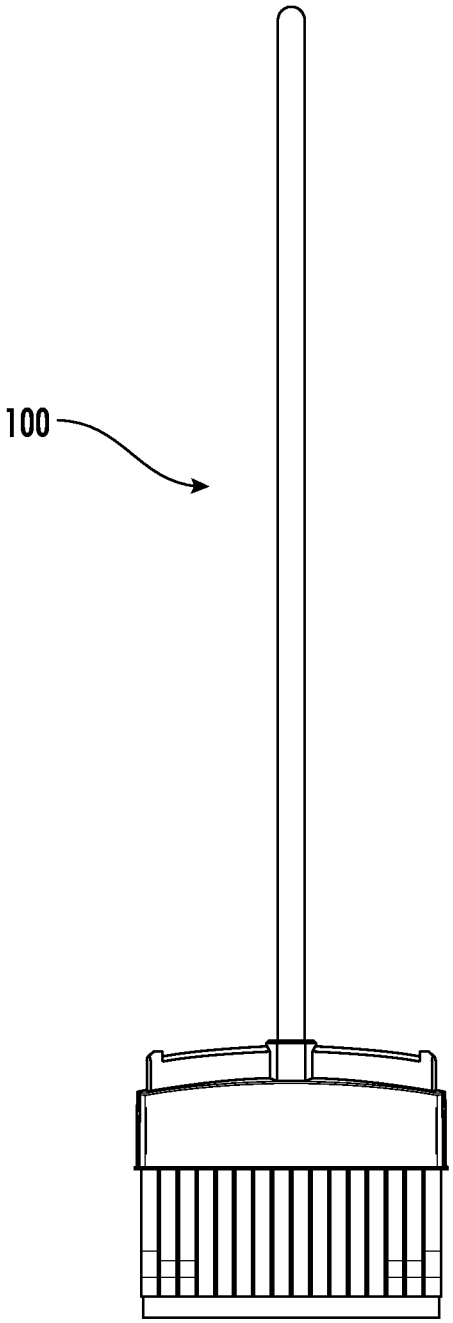
FIG. 4 illustrates a front view of the multifunctional tool apparatus of FIG. 1 with the first functional element in the second position.
Figure 5:
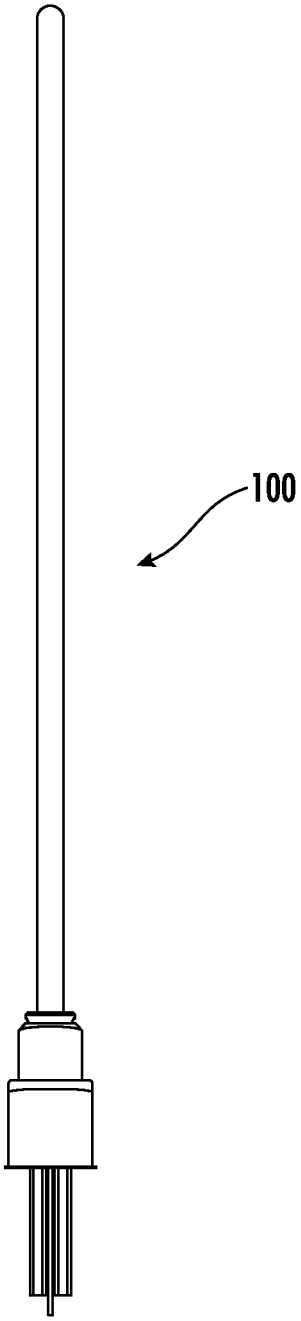
FIG. 5 illustrates a side view of the multifunctional tool apparatus of FIG. 1 with the first functional element in the second position.
Figure 6:
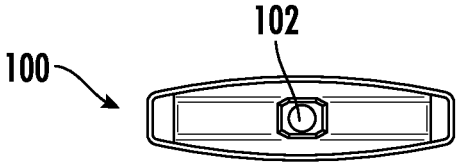
FIG. 6 illustrates a top view of the multifunctional tool of FIG. 1.
Figure 7:
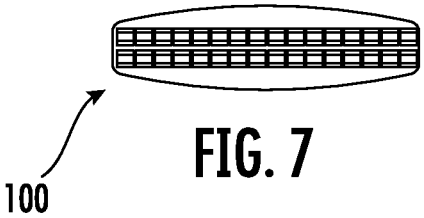
FIG. 7 illustrates a bottom view of the multifunctional tool of FIG. 1.

The second housing member 112 is supported for translation by the first housing member 110. The second housing member 112 slides or translates relative to the first housing member 110 and the handle 102. The second housing member 112 is movable between a first position as shown in FIG. 1 and a second position as shown in FIG. 2.

In one example, and as shown in FIGS. 1-7, the second housing member 112 forms a shell and surrounds the first housing member 110. The second housing member 112 has a first end region 120 and a second end region 122 opposite to the first end region 120. In various examples, the second end region 122 may face away from the handle 102. The second housing member 112 has first and second opposed faces 124 extending between the first and second end regions 120, 122, and first and second opposed sides 126 extending between the first and second end regions 120, 122. The first end region 120 and the second end region 122 of the second housing member 112 may each form an aperture or slot 127 therethrough, with both apertures 127 intersecting a cavity is formed within the second housing member 112 and sized to receive the first housing member 110.

A second functional element 130, or second cleaning element 130, is supported by and attached to the second housing member 112. The second cleaning element 130 has a proximal end attached to the second housing member 112 and extending outwardly from the second end region 122 of the second housing member 112 to a distal end 132. The second cleaning element 130 extends across the second end region 122 of the housing member 112 and may be adjacent to both the first and second sides 126 of the second housing member 112. In one example, the second cleaning element 130 is fixed relative to the second housing member 112 such that it moves with the second housing member 112.

The first and second housing members 110, 112 move relative to one another such that the first and second cleaning elements 116, 130 move relative to one another as the second housing member 112 slides or translates relative to the first housing member 110.

As shown in FIG. 1, the second housing member 112 and second cleaning element 130 are in a first, deployed position for use on a surface. In FIG. 1, the first cleaning element 116 is not available for use on the surface. With the second cleaning element 130 in the first position, the distal end 118 of the first cleaning element 116 is positioned between the distal end 132 of the second cleaning element 130 and the housing assembly 106, such that the second cleaning element 130 is extended relative to the first cleaning element 116. Therefore, the second cleaning element 130 is available for use in a cleaning application with the second cleaning element 130 in the first position.

FIG. 2 illustrates the second housing member 112 and second cleaning element 130 in a second, retracted position for storage such that the first cleaning element 116 may be used on a surface. The distal end 132 of the second cleaning element 130 is positioned between the distal end 118 of the first cleaning element 116 and the housing assembly 106 such that it is retracted relative to the first cleaning element 116. Therefore, the first cleaning element 116 is available for use in a cleaning application with the second cleaning element 130 in the second position.

A mechanism 140 is provided on the housing assembly 106 to lock or retain the second housing member 112 in each of the first and second positions. According to one example, a user input to the mechanism 140 may be provided by an input member 142. The input member 142 may be supported by the housing assembly 106 and provide a user input to the mechanism 140 to move the housing members 110, 112 relative to one another such that the second cleaning element 130 moves from the first position to the second position, or vice versa. The input member 142 may be adjacent to the first end region 114 of the first housing member 110, and may be activated via the foot of a user, e.g. by pressing or stepping on the input member 142. In one example, the input member 142 is provided by a kick-plate and the user input is provided as force input in translation along the axis 104.

In use, the user may step or push on the input member 142 to activate the mechanism 140 such that the second cleaning member 130 moves from the first position to the second position, and is locked in the second position. When the user is done with the first cleaning member 116, or wants to use the second cleaning member 130, the user steps or pushes on the input member 142 again to activate the mechanism 140 such that the second cleaning member 130 moves from the second position to the first position, and is locked in the first position.

For example, a user may simply lift the apparatus 100, and step on the kick-plate 142 to extend the first cleaning element 116 relative to the second cleaning element 130. In the example shown, the first cleaning element 116 is a squeegee to remove liquid or dust on surfaces such as glass. When finished with the first cleaning element 116, the user then provides another push to the kick-plate 142 to release it and have it retract relative to the second cleaning element 130. In the example shown, the second cleaning element 130 is a broom to sweep up dry dirt or debris.

The first and second cleaning elements 116, 130 are provided with the cleaning apparatus 100 based on the intended use for the cleaning apparatus, e.g. the types of surfaces and types or dirt or debris, and the first and second cleaning elements 116, 130 are different from one another. Dirt and debris may include hair, grout stains, dirt, glass, scuffs, dust, mud or tracks, food, liquids, and the like. Various cleaning applications used as examples herein include: pets, children, deep cleaning or deep messes, an apartment or other interior, bathrooms, kitchens, outdoor living spaces such as a deck, and garages. In further examples, the first and second cleaning elements 116, 130 may be specifically selected based on the room or space to be cleaned, for example, for a living room, a bedroom, a baby room or nursery, a closet, a pantry, a mudroom, an entry hall or foyer, an entertainment room, an exercise room, or the like.

Figure 8A:
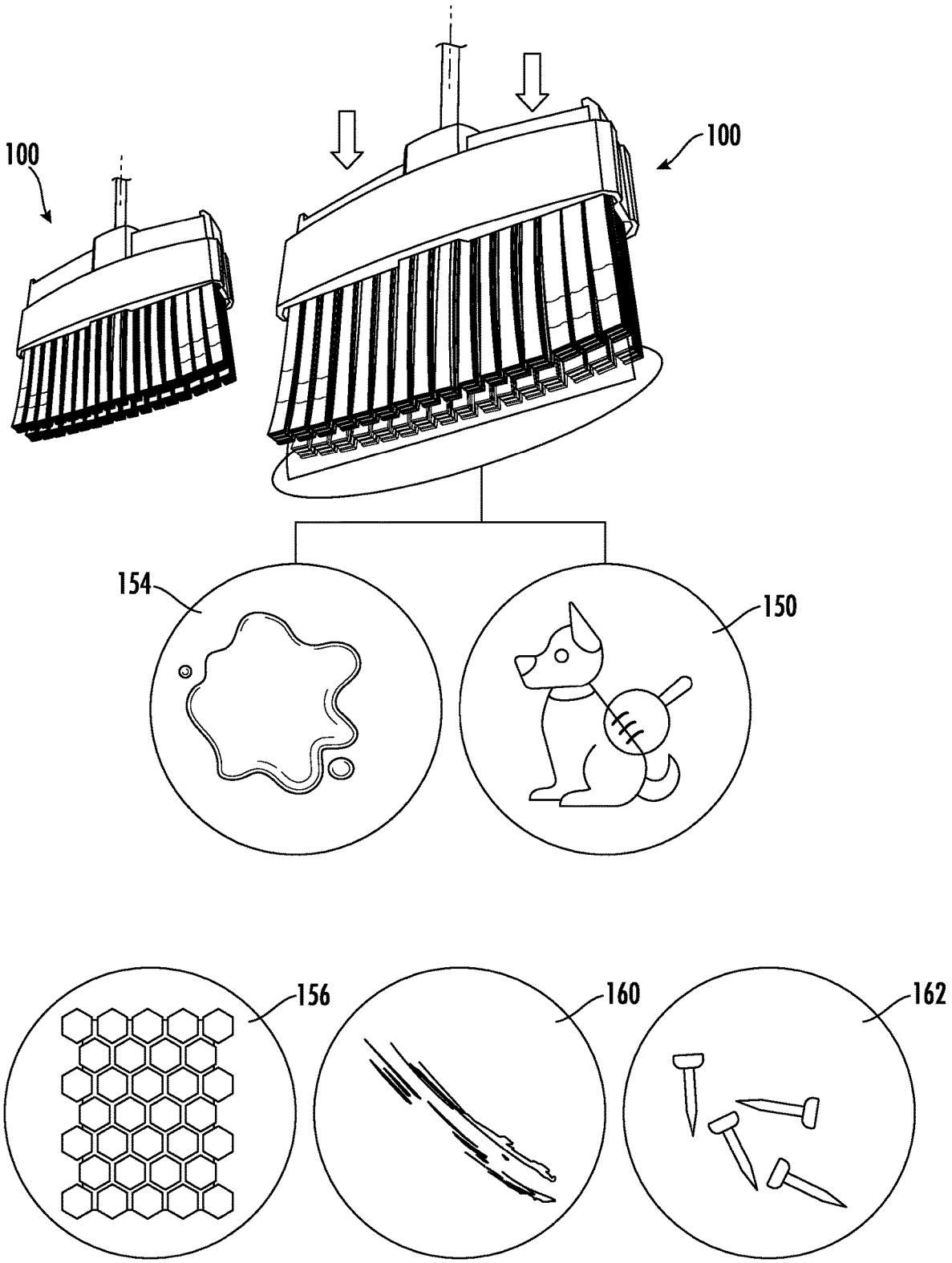
FIGS. 8A and 8B illustrate a schematic of various cleaning elements for use as a first functional element with the multifunctional tool of FIG. 1.
Figure 8B:
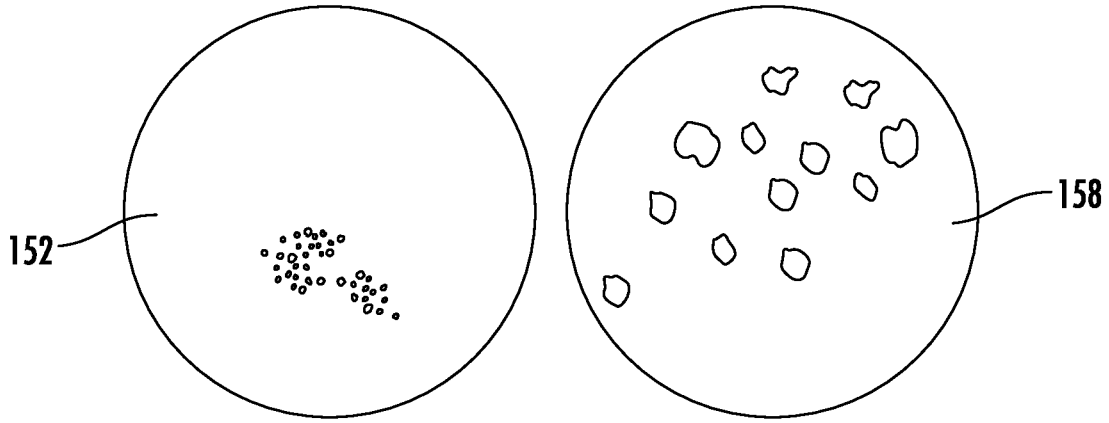

Non-limiting examples of cleaning elements and surfaces for cleaning by the apparatus 100 are shown schematically in FIGS. 8A and 8B and include: a rubber brush 150 or bristles for debris such as hair or pet hair, microfiber 152 for flat surfaces or fine dust, a squeegee 154 for wet surfaces, a brush or bristles 156 for scrubbing grout, a light stiffness or soft brush for fine dust, a medium stiffness brush for medium dirt, a heavy stiffness brush 158 for heavy scrubbing, an eraser 160 for marks or scuffs, a scraper for hard gunk, and a magnetic bar 162 for nails or the like. In other examples, and for use with a multifunctional tool, other functional elements 116, 130 may be used based on the applications or uses, such as to provide for cleaning of both wet and dry messes.

In one example, the first cleaning element 116 may be a squeegee as shown, or may be another cleaning element as described above. The second cleaning element 130 is provided by a brush with first and second sets 170, 172 of bristles. The first cleaning element 116 may be positioned between the first and second sets 170, 172 of bristles.

Figure 9:
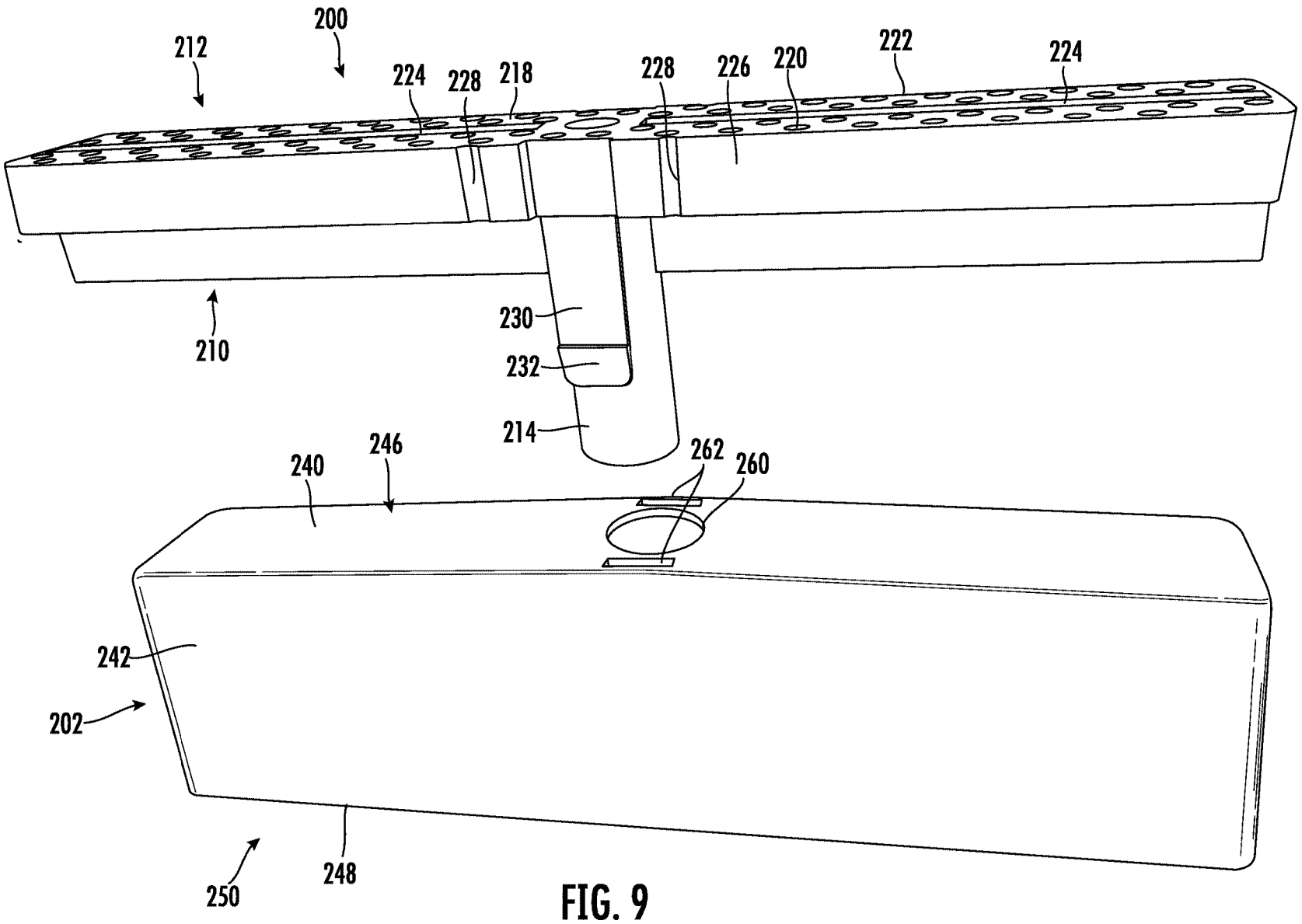
FIG. 9 illustrates a perspective view of housing members for use with the multifunctional tool of FIG. 1 according to an embodiment.
Figure 10:
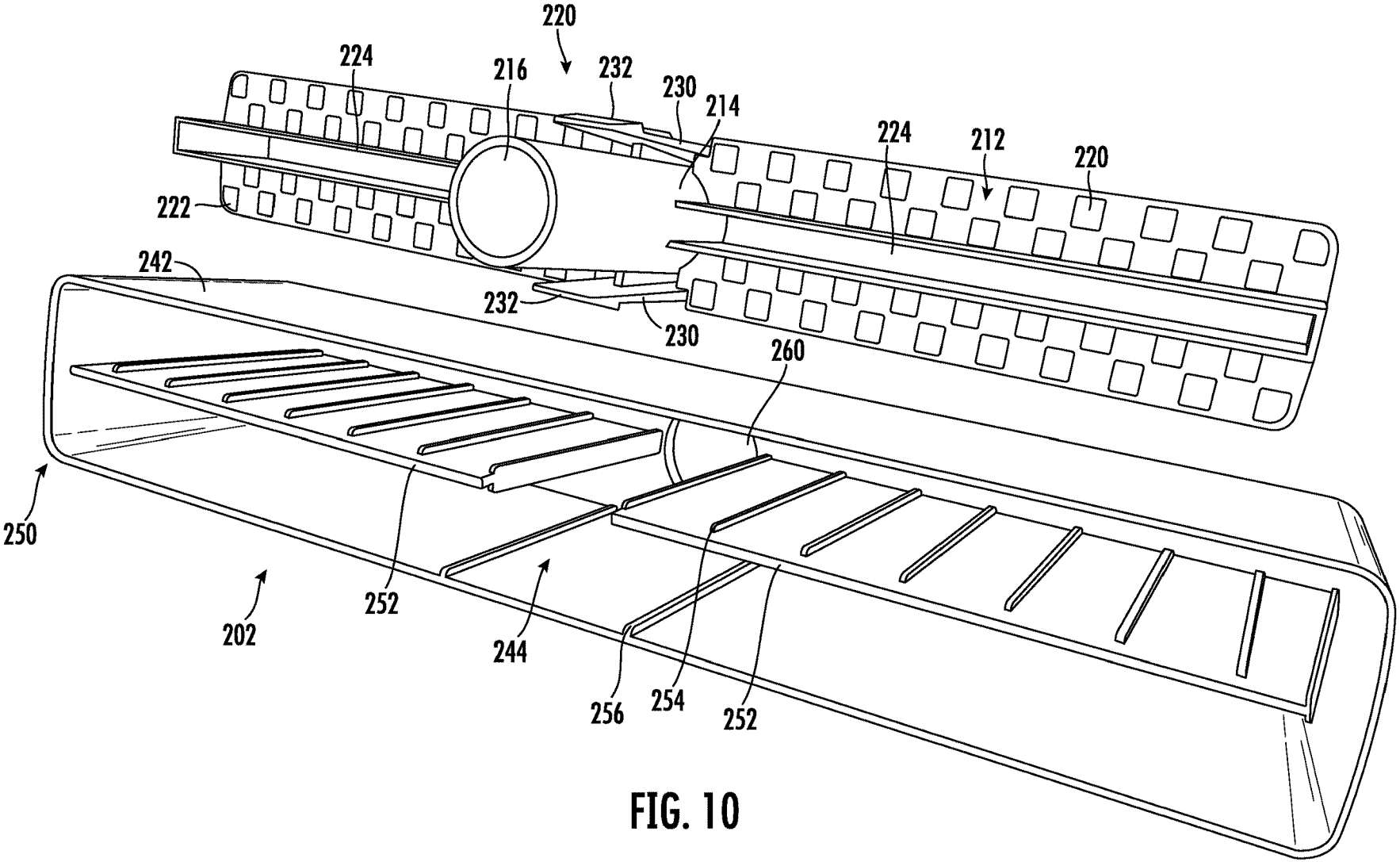
FIG. 10 illustrates another perspective view of the housing members of FIG. 9.
Figure 11:
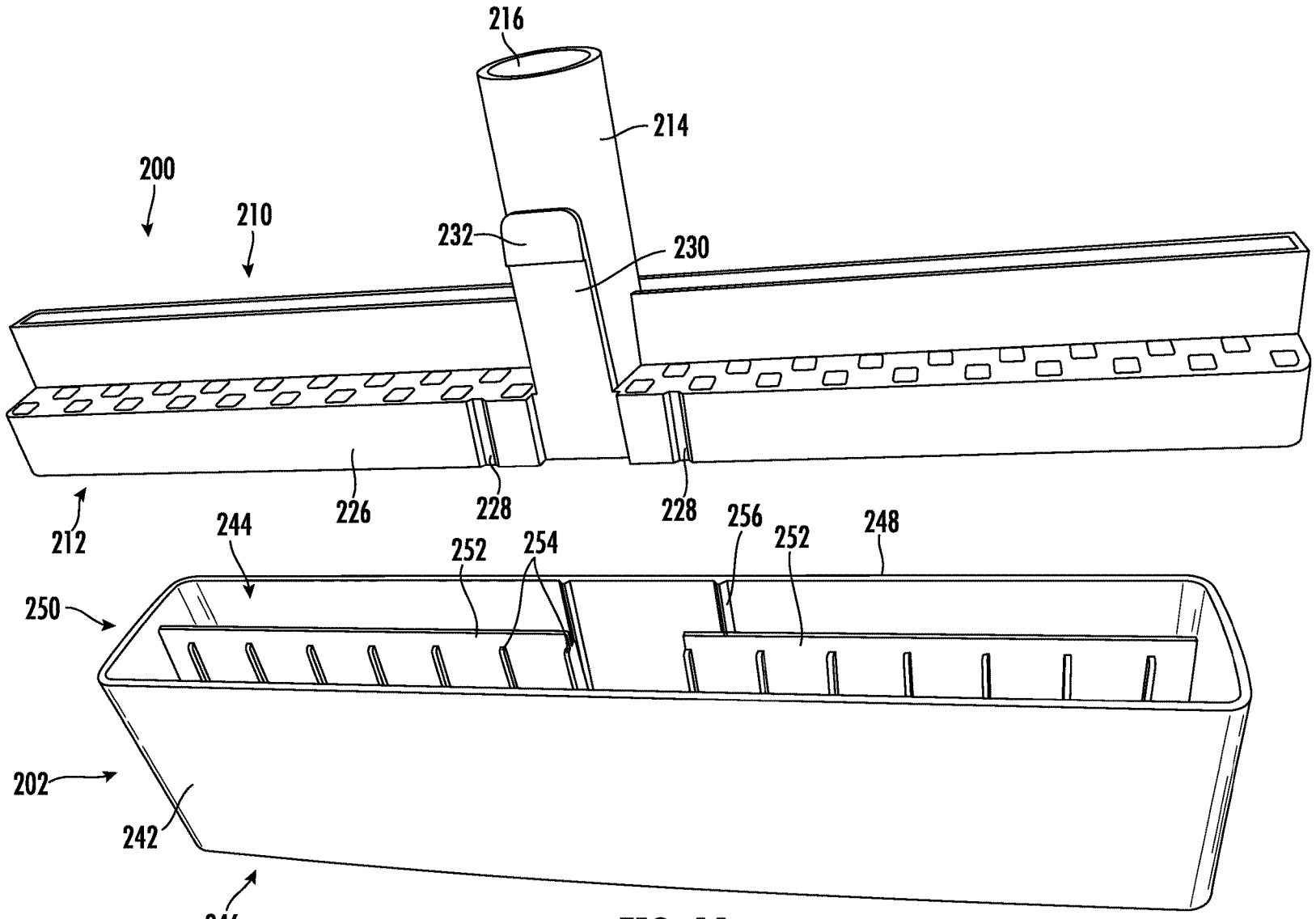
FIG. 11 illustrates yet another perspective view of the housing members of FIG. 9
Figure 12:
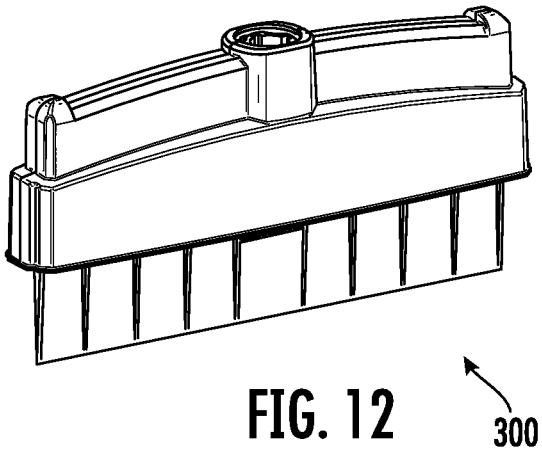
FIG. 12 illustrates a perspective view of housing members for use with the multifunctional tool of FIG. 1 according to another embodiment.
Figure 13:
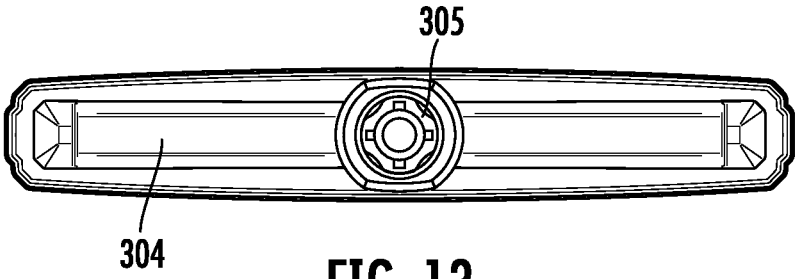
FIG. 13 illustrates a top view of the housing members of FIG. 12.
Figure 14:
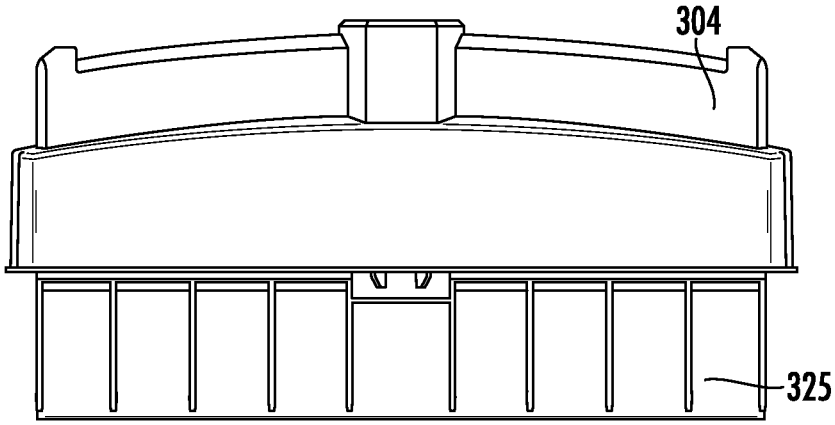
FIG. 14 illustrates a side view of the housing members of FIG. 12.
Figure 15:
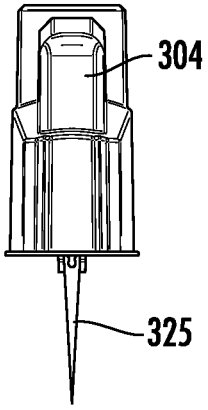
FIG. 15 illustrates a front view of the housing members of FIG. 12.
Figure 16:
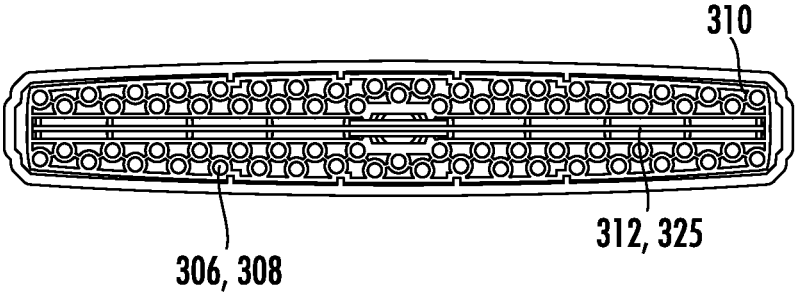
FIG. 16 illustrates a bottom view of the housing members of FIG. 12.

FIGS. 9-11 illustrate various perspective views of a first housing member 200 and a second housing member 202. The first and second housing members 200, 202 as shown in FIGS. 9-11 may be used to form the housing assembly 106 of FIG. 1 according to a further embodiment.

The first housing member 200 has a first end region 210 and a second opposite end region 212. A handle support member 214 extends outwardly from the first end region 210 and forms an aperture 216 sized to receive a handle, such as the handle 102 described above.

The second end region 212 defines a lower face 218 of the housing member 200. The lower face 218 defines a first series of apertures 220 and a second series of apertures 222. Each of the first and second series of apertures 220, 222 receive a portion of a first cleaning element. According to the present example and with reference to FIGS. 9-11, the first cleaning element is a brush, with a first set of bristles received within the first series of apertures 220, and a second set of bristles received in the second series of apertures 222.

The lower face 218 also defines one or more slots 224 that extend through the first housing member 200. In the example shown, the lower face 218 defines two slots 224. The slots 224 are positioned between the first and second series of apertures 220, 222.

The first housing member 200 has an outer wall 226 that extends circumferentially around the first housing member 200 and is positioned between the first and second end regions 210, 212. The outer wall 226 may define one or more first guide elements 228 that extend in a direction parallel to the longitudinal axis 104 of the handle 102.

The first housing member 200 also defines first and second locking elements 230. The first and second locking elements 230 extend outwardly from the first end region 210 of the first housing member 200, and may be positioned adjacent to and on either side of the handle support member 214. Each of the first and second locking elements 230 may define one or more clip protrusions 232. In the example shown, each locking element 230 has a single clip protrusion 232. In another example, each locking element 230 has two clip protrusions 232 spaced apart from one another on the associated locking element 230.

The second housing member 202 surrounds the first housing member 200 when it is assembled to the first housing member 200, and the second housing member 202 translates relative to the first housing member 200 between a first position and a second position as described below.

The second housing member 202 has an upper wall 240 and an outer side wall 242 that extends outwardly from the upper wall 240 and circumferentially surrounds a cavity 244 defined by the second housing member 202. The upper wall 240 provides a first end region 246 of the second housing member 202, and the distal end 248 of the outer side wall 242 forms a second end region 250 of the second housing member 202. The cavity 244 of the second housing member 202 is sized to receive the first housing member 200 such that the outer wall 242 surrounds the first housing member 200.

The second housing member 202 defines a divider 252 that extends within the cavity 244. The divider 252 may be split into a first divider section and a second divider section. The second cleaning element is connected to or supported by the divider 252. The second cleaning element extends outwardly from the divider 252 and away from the first end region 246 of the second housing member 202. In the example shown and with reference to FIGS. 9-11, the second cleaning element is a squeegee and is provided as a first and second squeegee connected to the first and second sections of the divider 252, respectively.

When the first housing member 200 is assembled with the second housing member 202, the sections of the divider 252 extend through the slots 224 and aid in maintaining the alignment of the second housing member 202 relative to the first housing member 200.

The divider 252 may be provided with ribs 254 to assist in locating the first housing member 200 relative to the second housing member 202, as well as allow for reduced friction between the housing members 200, 202 during movement.

The inner face of the outer wall 242 may be provided with one or more second guide elements 256 that extend in a direction parallel to the longitudinal axis of the handle. The second guide elements 256 cooperate with the first guide elements 228 to assist in locating, and guiding the second housing member 202 as it moves relative to the first housing member 200. In the example shown, the first and second guide elements 228, 256 are provided by grooves and projections that mate with one another.

The upper wall 240 or the first end region 246 defines an aperture 260 extending therethrough. The aperture 260 is sized to receive the handle support member 214 for translation therein.

The first end region 246 also defines first and second openings 262. The first and second openings 262 are sized to receive the first and second locking elements 230, respectively. The first and second openings 262 are also sized to cooperate with the clip protrusions 232 on each locking element 230 to maintain a position of the second housing member 202 relative to the first housing member 200.

In one example, the locking elements 230 and openings 262 provide a part of the mechanism 140 and input member 142 as described above. In a further example, one or more spring members may be positioned within the cavity 244 and between the first end region 246 of the second housing member 202 and the first end region 210 of the first housing member 200 to bias the second housing member 202 towards a position with the second cleaning element deployed for use.

In use, the first housing member 200 is received within the cavity 244 of the second housing member 202. The handle support member 214 extends through the aperture 260. The first and second locking elements 230 extend through the openings 262. The first and second locking elements 230 may act as spring clip. To move or translate the second housing member 202 relative to the first housing member 200, the user may press the ends of the first and second locking elements 230 towards one another such that the protrusions 232 disengage from the openings 262.

Figure 17:
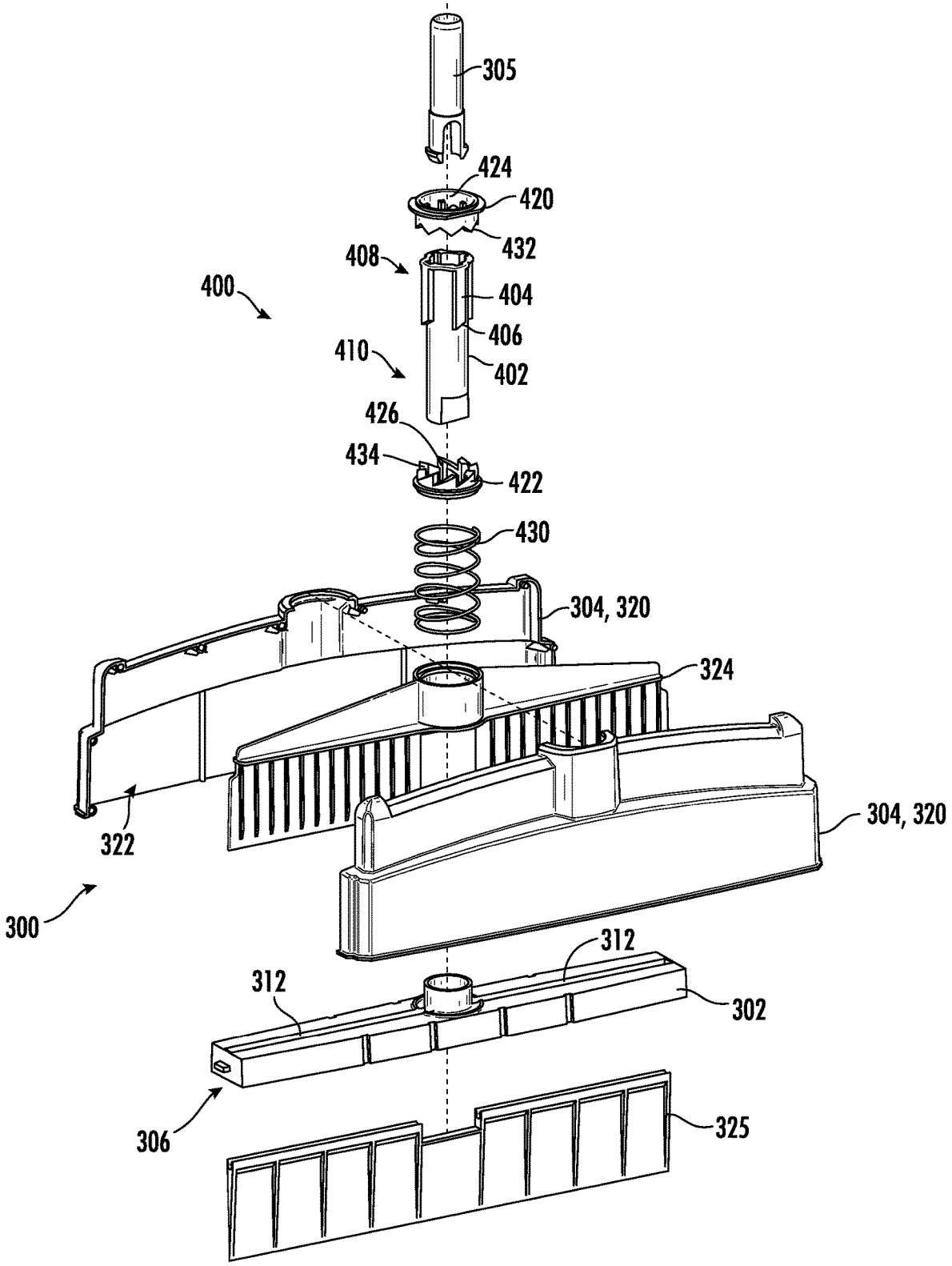
FIG. 17 illustrates an exploded view of the housing members of FIG. 12 and a mechanism according to an embodiment.
Figure 18:
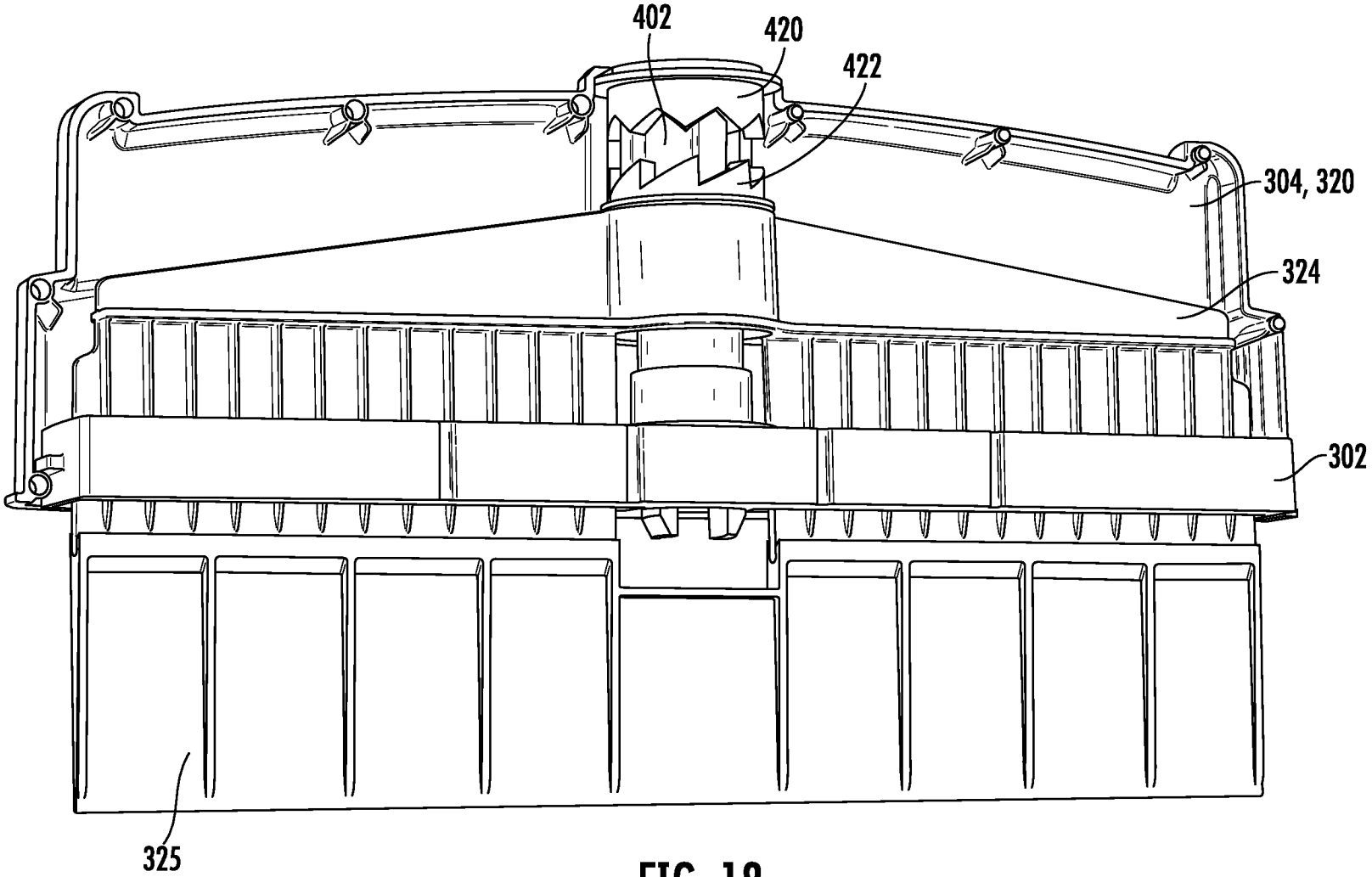
FIG. 18 illustrates a partially disassembled view of the housing members and mechanism of FIG. 17.
Figure 19:
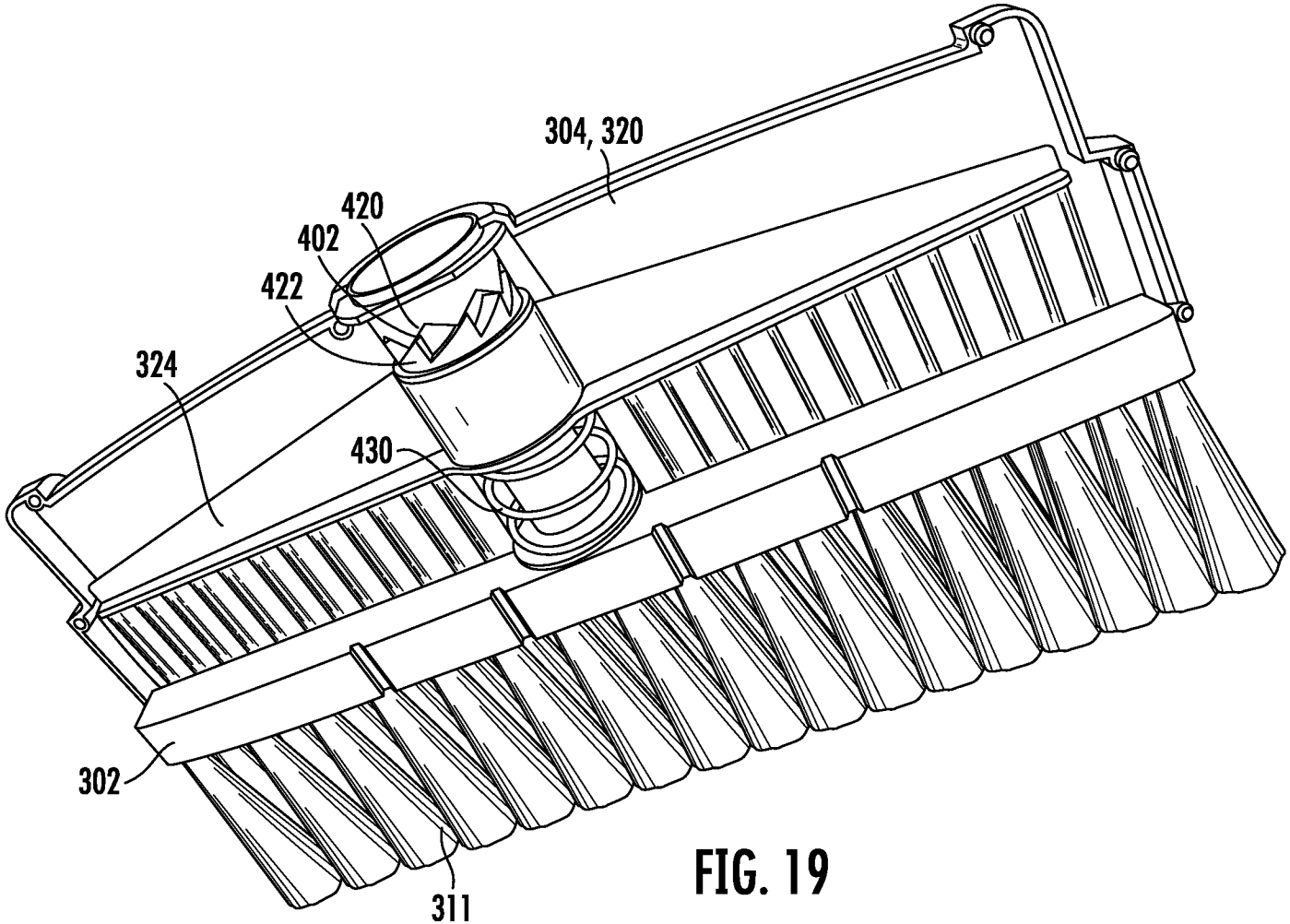
FIG. 19 illustrates another partially disassembled view of the housing members and mechanism of FIG. 17.

FIGS. 12-16 illustrates various views of a tool 300 with housing members 302, 304. The tool may operate similar to that described above with respect to FIGS. 1-11. FIG. 17 illustrates an exploded view of the tool 300 with a mechanism 400. The mechanism 400 may function similarly to that described above with respect to mechanism 140. FIGS. 18-19 illustrate partially disassembled views of the tool 300, including mechanism 400, of FIGS. 12-17. FIGS. 12-19 may include elements as described above with reference to FIGS. 1-11.

The tool has a first housing member 302 and a second housing member 304. A handle support member 305 extends outwardly from the first housing member 302, and is sized to receive a handle, such as handle 102 described above. The handle support member 305 may be fixed to the first housing member 302 such that handle support member 305 does not move relative to the first housing member.

The first housing member 302 also defines a lower face 306. The lower face 306 defines a first series of apertures 308 and a second series of apertures 310. Each of the first and second series of apertures 308, 310 receive a portion of a first cleaning element 311. According to the present example and with reference to FIG. 19, the first cleaning element is a brush, with a first set of bristles received within the first series of apertures 308, and a second set of bristles received in the second series of apertures 310. Note that the first cleaning element is not shown in FIGS. 12-18 for clarity.

The lower face 306 also defines one or more slots 312 that extend through the first housing member 302, and has two slots 312 in the example shown. The slots 312 are positioned between the first and second series of apertures 308, 310.

The second housing member 304 has a shell 320 that forms an outer wall and extends circumferentially around the first housing member 302. The shell 320 may be formed from multiple shell components that are assembled to one another. The shell 320 of the second housing member 304 surrounds the first housing member 302 when it is assembled to the first housing member 302, and the second housing member 304 translates relative to the first housing member 302 between a first position and a second position as described above. The shell 320 defines a cavity 322 that is sized to receive the first housing member 302.

The second housing member 304 defines a divider 324 that extends within the cavity 322. The divider 324 may be split into a first divider section and a second divider section. The second cleaning element 325 is connected to or supported by the divider 324. The second cleaning element 325 extends outwardly from the divider 324 as shown. In the example shown and with reference to FIGS. 12-19, the second cleaning element 325 is a squeegee and is connected to the first and second sections of the divider 324, respectively.

When the first housing member 302 is assembled with the second housing member 304, the sections of the divider 324 extend through the slots 312 and aid in maintaining the alignment of the second housing member 304 relative to the first housing member 302. The first and second housing members 302, 304 may additionally have guide elements that cooperate with one another to assist in locating the housing members relative to one another, as well as reduce sliding friction between the housing members.

With reference to FIGS. 17-19, further details of the housing members 302, 304 and mechanism 400 are shown.

The mechanism 400 has a guide member 402 that slides over the handle support 305. The guide member 402 has a series of protrusions 404 or stop members that extend along the longitudinal direction to a distal end in the intermediate region of the ratchet member. The distal ends of the series of protrusions each have an inclined face 406. The series of protrusions extend along an upper region 408 of the guide member. The lower region 410 of the guide member is cylindrical and without protrusions or guide members.

The mechanism 400 has a plunger 420 and a cam 422. The plunger 420 and cam 422 each define an aperture that receives the guide member 402 therethrough. The plunger 420 and cam 422 may each slide along the guide member 402 between the upper and lower regions 408, 410. The plunger 420 has a series of guides 424 that engage the series of protrusions 404 and prevent the plunger 420 from rotating relative to the guide member 402 when the plunger is in the upper region 408 of the guide member. Note that the plunger 420 may remain at least partially in the upper region of the guide member 402 during operation of the mechanism 400. The cam 422 likewise has a series of guides 426 that engage the series of protrusions 404 and prevent the cam 422 from rotating relative to the guide member 402 when the cam is in the upper region 408 of the guide member. In operation, the cam may move into the lower region 410 of the guide member 402 and rotate relative to the guide member 402 as described below.

The plunger 420 and cam 422 are biased towards the upper region 408 of the guide member 402 by a biasing member 430. In one example, the biasing member 430 is a spring as shown. The biasing member 430 is positioned between the divider 324 and the first housing member 302 as shown in FIGS. 18-19, and exerts a force on the divider 324, cam 422, plunger 420, and shell 320.

The plunger 420 has a series of teeth 432, and the cam 422 has another series of teeth 434, that engage the teeth of the plunger when the mechanism 400 is activated.

In use, and to move the second cleaning element 325 to an extended position, or use position, the user inputs a force, e.g. via a foot, to the upper surface of the shell 320, or kick plate region. This slides the plunger 420 and cam 422 along the guide member 402 towards the lower region 410 of the guide member, and compresses the biasing member 430. When the cam 422 is in the lower region 410 of the guide member 402, the cam 422 rotates through a predefined angle relative to the plunger 420 as the teeth 434 of the cam slide on the teeth 432 of the plunger. When the input force is released from the shell 320, the plunger 420 retracts along the guide member 402 and away from the lower region 408; however, the cam 422 is retained in the lower region 410 of the guide member based on the engagement between the inclined faces 406 of the protrusions and the teeth 434 of the cam. The cam 422 abuts the divider 324, and therefore positions the second cleaning element 325 relative to the first housing member 302.

To move the second cleaning element 325 from the extended position to a retracted position, e.g. to use the first cleaning element, the user inputs a force, e.g. via a foot, to the upper surface of the shell 320. This slides the plunger 420 towards the lower region 410 of the guide member until it engages the cam 422, and compresses the biasing member 430. The teeth 432 of the plunger engage the teeth 434 of the cam, and the plunger 420 moves the cam 422 into the lower region 410 of the guide member, and away from the inclined faces 406. Once the cam 422 is spaced apart from the inclined faces 406 of the protrusions, the cam 422 then rotates through a predefined angle relative to the plunger 420 based on the teeth 434 of the cam sliding along the teeth 432 of the plunger. This aligns the cam 422 relative to the series of protrusions 404, such that when the input force is released from the shell 320, the biasing member 430 biases and slides the cam 422 and plunger 420 into the upper region 408 of the guide member, and retracts the divider 324 and the second cleaning element 325 into the cavity 322 of the shell 320 of the second housing member 304.

The handle support member 305 extends through and is connected to and affixed to the first housing member 302. The mechanism 400 is positioned between the first housing member 302 and the second housing member 304. The guide member 402, plunger 420, and cam 422 are positioned between the shell 320 and the divider 324. The guide member 402, plunger 420, and cam 422 surround the handle support 305 and are movable relative to the handle support 305. The biasing member 430 is positioned between the divider 324 and the first housing member 302. The guide member 402 and the cam 422 may provide first and second locking elements for the mechanism 400.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A multifunctional tool comprising:

a first housing member;

a first functional element connected to the first housing member and extending outwardly therefrom to a first distal end;

a second housing member supported by the first housing member for translation along a longitudinal axis and relative to the first housing member between a first position and a second position;

a second functional element supported by the second housing member and extending outwardly therefrom to a second distal end;

a mechanism to retain the second housing member in each of the first and second positions;

a kick plate supported by one of the first and second housing members and connected to the mechanism, the kick plate positioned to move in translation along the longitudinal axis in response to a force input in translation along the longitudinal axis by a foot of a user to an upper surface of the kick plate;

wherein the second distal end is positioned between the first housing member and the first distal end with the second housing member in the first position;

wherein the first distal end is positioned between the first housing member and the second distal end with the second housing member in the second position; and wherein the kick plate is operable by the user to engage the mechanism to move the second housing member between the first and second positions.

2. The multifunctional tool of claim 1 further comprising a handle connected to and extending outwardly from the first housing member, the handle being fixed relative to the first housing member.

3. The multifunctional tool of claim 2 wherein the second housing member translates along the longitudinal axis of the handle.

4. The multifunctional tool of claim 1 wherein the second functional element is different from the first functional element.

5. The multifunctional tool of claim 1 wherein the second housing member defines a cavity; and wherein the first housing member is received within the cavity.

6. The multifunctional tool of claim 1 wherein the mechanism comprises at least one locking element supported by one of the first and second housing members, and an opening defined by the other of the first and second housing members.

7. The multifunctional tool of claim 6 wherein the at least one locking element defines a clip protrusion, the clip protrusion cooperating with the opening to retain the second housing element in one of the first and second positions.

8. The multifunctional tool of claim 1 wherein the first functional element is one of a rubber brush, a first microfiber, a second microfiber, a squeegee, a foam member, an angled brush, a light stiffness brush, a medium stiffness brush, a heavy stiffness brush, an eraser, a scraper, and a magnetic bar.

9. The multifunctional tool of claim 8 wherein the second functional element is another of the rubber brush, the first microfiber, the second microfiber, the squeegee, the foam member, the angled brush, the light stiffness brush, the medium stiffness brush, the heavy stiffness brush, the eraser, the scraper, and the magnetic bar.

10. The multifunctional tool of claim 1 wherein the first housing member defines a handle support member extending outwardly from a first end region, and a lower face defined by a second end region opposite to the first end region; and wherein the first functional element extends outwardly from the lower face.

11. A multifunctional tool comprising:

a first housing member;

a first functional element connected to the first housing member and extending outwardly therefrom to a first distal end;

a second housing member supported by the first housing member for translation relative to the first housing member between a first position and a second position;

a second functional element supported by the second housing member and extending outwardly therefrom to a second distal end;

a mechanism to retain the second housing member in each of the first and second positions; and a kick plate supported by one of the first and second housing members and connected to the mechanism;

wherein the second distal end is positioned between the first housing member and the first distal end with the second housing member in the first position;

wherein the first distal end is positioned between the first housing member and the second distal end with the second housing member in the second position;

wherein the kick plate is operable by a user to engage the mechanism to move the second housing member between the first and second positions;

wherein the first housing member defines a handle support member extending outwardly from a first end region, and a lower face defined by a second end region opposite to the first end region;

wherein the first functional element extends outwardly from the lower face;

wherein the second housing member defines an outer side wall extending outwardly from an upper wall, the outer side wall and upper wall defining a cavity, the outer side wall circumferentially surrounding the cavity; and wherein the first housing member is sized to be received within the cavity.

12. The multifunctional tool of claim 11 wherein the upper wall defines an aperture, the handle support member extending through the aperture.

13. The multifunctional tool of claim 12 wherein the first housing member defines first and second locking elements, the handle support member positioned between the first and second locking elements; and wherein the upper wall defines first and second slots, the aperture positioned between the first and second slots, the first and second slots sized to receive the first and second locking elements, respectively, to retain the second housing member in one of the first and second positions.

14. A multifunctional tool comprising:

a first housing member defining a handle support member extending outwardly from a first end region, and a lower face defined by a second end region opposite to the first end region;

a first functional element connected to the first housing member and extending outwardly from the lower face to a first distal end;

a second housing member supported by the first housing member for translation relative to the first housing member between a first position and a second position, wherein the second housing member defines an outer side wall extending outwardly from an upper wall, the outer side wall and upper wall defining a cavity, wherein the first housing member is sized to be received within the cavity;

a second functional element supported by the second housing member and extending outwardly therefrom to a second distal end;

wherein the second distal end is positioned between the first housing member and the first distal end with the second housing member in the first position;

wherein the first distal end is positioned between the first housing member and the second distal end with the second housing member in the second position;

wherein the first housing member defines a slot extending therethrough and intersecting the lower face; and wherein the second housing member defines a divider extending outwardly from the upper wall and positioned within the cavity, the divider extending through the slot.

15. The multifunctional tool of claim 14 wherein the divider defines a series of ribs extending outwardly therefrom to position the first housing member relative to the second housing member.

16. The multifunctional tool of claim 14 wherein the second functional element is connected to the divider.

17. The multifunctional tool of claim 16 wherein a first portion of the first functional element and a second portion of the first functional element extend outwardly from the lower face of the first housing member, the slot positioned between the first and second portions of the first functional element.

18. The multifunctional tool of claim 16 wherein the first functional element is a brush.

19. The multifunctional tool of claim 18 wherein the second functional element is one of a microfiber, a squeegee, an eraser, and a magnetic bar.

20. A multifunctional tool comprising:

a first housing member defining a handle support member extending outwardly from a first end region, and a lower face defined by a second end region opposite to the first end region;

a first functional element connected to the first housing member and extending outwardly from the lower face to a first distal end;

a second housing member supported by the first housing member for translation relative to the first housing member between a first position and a second position, wherein the second housing member defines an outer side wall extending outwardly from an upper wall, the outer side wall and upper wall defining a cavity, the outer side wall circumferentially surrounding the cavity, wherein the first housing member is sized to be received within the cavity such that the outer side wall surrounds the first housing member;

a second functional element supported by the second housing member and extending outwardly therefrom to a second distal end;

wherein the second distal end is positioned between the first housing member and the first distal end with the second housing member in the first position;

wherein the first distal end is positioned between the first housing member and the second distal end with the second housing member in the second position; and wherein the first housing member defines a first guide element, and the second housing member defines a second guide element cooperating with the first guide element.

21. The multifunctional tool of claim 20 further comprising a mechanism comprising at least one locking element supported by one of the first and second housing members, and an opening defined by the other of the first and second housing members;

wherein the mechanism retains the second housing member in each of the first and second positions; and wherein the at least one locking element defines a clip protrusion, the clip protrusion cooperating with the opening to retain the second housing element in one of the first and second positions.

* * * * *